US012741794B2

(12) United States Patent
Hodges

(10) Patent No.: US 12,741,794 B2
(45) Date of Patent: Sep. 22, 2026

(54) COLLATION OF PACKAGES AND METHOD OF RETAINING PACKAGES TOGETHER IN A COLLATION

(71) Applicant: NICOVENTURES TRADING LIMITED, London (GB)

(72) Inventor: Paul Hodges, London (GB)

(73) Assignee: NICOVENTURES TRADING LIMITED, London (GB)

( * ) Notice: Subject to any disclaimer, the term of this patent is extended or adjusted under 35 U.S.C. 154(b) by 0 days.

(21) Appl. No.: 18/697,625

(22) PCT Filed: Sep. 29, 2022

(86) PCT No.: PCT/GB2022/052462
§ 371 (c)(1),
(2) Date: Apr. 1, 2024

(87) PCT Pub. No.: WO2023/052766
PCT Pub. Date: Apr. 6, 2023

(65) Prior Publication Data

US 2024/0409289 A1 Dec. 12, 2024

(30) Foreign Application Priority Data

Sep. 30, 2021 (GB) ..... 2113998

(51) Int. Cl.
*B65D 71/00* (2006.01)
*B65D 63/10* (2006.01)
*B65D 85/10* (2006.01)

(52) U.S. Cl.
CPC ..... *B65D 71/0085* (2013.01); *B65D 63/1009* (2013.01); *B65D 85/1072* (2013.01)

(58) Field of Classification Search
CPC ..... B65D 71/0085; B65D 63/1009; B65D 85/1072
See application file for complete search history.

(56) References Cited

U.S. PATENT DOCUMENTS 2,779,526 A 1/1957 Vogt
4,669,611 A * 6/1987 Flaherty ..... B65D 75/52 40/486

(Continued)

FOREIGN PATENT DOCUMENTS

CH 686127 A5 1/1996
DE 4227713 A1 2/1994

(Continued)

OTHER PUBLICATIONS

PCT International Search Report and Written Opinion in International Appln. No. PCT/GB2022/052462, dated Dec. 21, 2022, 14 pages.

*Primary Examiner* — Shawn M Braden
(74) *Attorney, Agent, or Firm* — MERCHANT & GOULD P.C.

(57) ABSTRACT

A collation of packages, each package of the collation being cuboid-shaped and including a pair of opposing first faces, a pair of opposing second faces and an end face; wherein the packages are arranged in rows such that a second face of a package faces a second face of an adjacent package within the same row, and a first face of a package in a row faces a first face of a package in an adjacent row, a second face of a package at the ends of each row, a first face of each package in a row, and each end face being exposed; wherein the exposed end faces of the packages in the collation together form a surface; and wherein a single strip of tape is adhered only to said surface of the collation such that the single strip of tape attaches the packages in the collation together.

14 Claims, 6 Drawing Sheets

(56) References Cited

U.S. PATENT DOCUMENTS

| | | | | |
|---|---|---|---|---|
| 5,214,901 | A * | 6/1993 | Milliner | B65B 61/207 53/157 |
| 5,551,212 | A * | 9/1996 | Odenthal | B65B 13/02 53/399 |
| 8,758,708 | B2 * | 6/2014 | Brenneis | G01N 1/14 422/522 |
| 10,730,658 | B2 * | 8/2020 | Dhadda | B65D 5/52 |
| 12,054,330 | B2 * | 8/2024 | Pinkstone | B65B 51/02 |
| 12,286,288 | B2 * | 4/2025 | Hodges | B65D 85/1072 |
| 2015/0101957 | A1 * | 4/2015 | Ivosevic | B65D 19/0069 156/60 |

FOREIGN PATENT DOCUMENTS

| | | | |
|---|---|---|---|
| EP | 3406552 | A1 | 11/2018 |
| FR | 2986221 | A1 | 8/2013 |
| NL | 9301786 | A | 5/1995 |
| WO | 9964531 | A1 | 12/1999 |
| WO | 2012029976 | A1 | 3/2012 |
| WO | 2018210835 | A1 | 11/2018 |
| WO | 2021094738 | A1 | 5/2021 |

* cited by examiner

COLLATION OF PACKAGES AND METHOD OF RETAINING PACKAGES TOGETHER IN A COLLATION

RELATED APPLICATIONS

The present application is a National Phase entry of PCT Application No. PCT/GB2022/052462 filed Sep. 29, 2022, which claims priority to GB Application No. 2113998.5 filed Sep. 30, 2021, each of which is hereby incorporated by reference in their entirety.

TECHNICAL FIELD

The present invention relates to a collation of packages. A method of retaining packages together in a collation is also disclosed.

BACKGROUND

Known delivery systems, such as combustible and non-combustible aerosol provision systems and other tobacco industry products, are usually contained in packages. Often multiple packages are collated and placed in cartons. The cartons may be formed from cardboard or a similar material. Alternatively, the plurality of packages may be wrapped in plastic. The cartons and/or wrapping is opened to access individual packages.

SUMMARY

According to an aspect of the present disclosure, there is provided collation of packages, each package of the collation being cuboid-shaped and comprising a pair of opposing first faces, a pair of opposing second faces and an end face; wherein the packages are arranged in rows such that a second face of a package faces a second face of an adjacent package within the same row, and a first face of a package in a row faces a first face of a package in an adjacent row, a second face of a package at the ends of each row, a first face of each package in a row, and each end face, being exposed; wherein the exposed end faces of the packages in the collation together form a surface; and wherein a single strip of tape is adhered only to said surface of the collation such that the single strip of tape attaches the packages in the collation together.

Each of said packages may comprise a lid, and wherein said end face may be formed by the lid such that the exposed end faces of the packages in the collation together form a top surface.

Each of said packages may comprise a base, and wherein said end face may be formed by the base such the exposed end faces of the packages in the collation form a bottom surface.

Each of said packages may comprise a lid and a base, and wherein the end face may comprises a lid end face and a base end face, such that the exposed lid end faces of the packages in the collation form a top surface and the exposed base end faces of the packages in the collation form a bottom surface, wherein a single strip of tape may be adhered to each of the top surface and the bottom surfaces of the collation.

The single strip of tape may extend over the entire width of the collation.

The single strip of tape may extend over the entire length of the collation.

The single strip of tape may adhered to the entire surface of the collation to which it is attached.

The single strip of tape may comprise regions of adhesive, at least one region may be associated with each package in the collation such that the single strip of tape is adhered to every package.

The single strip of tape may comprise an extended tab configured to facilitate removal of the single strip of tape.

The single strip of tape may comprise an adhesive free region configured to facilitate removal of the single strip of tape from the collation.

The adhesive free region may be located at an end of the single strip of tape.

The adhesive free region may be located at a major edge of the single strip of tape and may extend along the length of the collation.

The single strip of tape may comprise a pair of adhesive free regions, each adhesive free region may be located at a major edge of the single strip of tape and may extend along the length of the collation.

According to another aspect of the present disclosure, there is provided a method of retaining packages together in a collation, the method comprising: providing a collation of cuboid-shaped packages, each package comprising a pair of opposing first faces, a pair of opposing second faces and an end face; arranging the packages in rows such that a second face of a package faces a second face of an adjacent package within the same row, and a first face of a package in a row faces a first face of a package in an adjacent row, a second face of a package at the ends of each row, a first face of each package in a row, and each end face being exposed; forming a surface with the exposed end faces of the packages in the collation; and adhering a single strip of tape only to said surface of the collation to attach the packages in the collation together.

BRIEF DESCRIPTION OF THE DRAWINGS

So that the invention may be more fully understood, embodiments of the present invention will now be described, by way of example only, with reference to the accompanying drawings, in which.

DETAILED DESCRIPTION

As used herein the term "delivery system" is intended to encompass systems that deliver a substance to a user, and includes:

- combustible aerosol provision systems, such as cigarettes, cigarillos, cigars, and tobacco pipes or for roll-your-own cigarettes (whether based on tobacco, tobacco derivatives, expanded tobacco, reconstituted tobacco, tobacco substitutes or other smokeable material);
- non-combustible aerosol provision systems that release compounds from an aerosolizable material without combusting the aerosolizable material, such as electronic cigarettes, tobacco heating products, and hybrid systems to generate aerosol using a combination of aerosolizable materials;

articles comprising aerosolizable material and configured to be used within one of these non-combustible aerosol provision systems; and aerosol-free delivery systems, such as lozenges, gums, patches, articles comprising inhalable powders, and smokeless tobacco products such as snus and snuff, which deliver a material to a user without forming an aerosol, wherein the material may or may not comprise nicotine.

According to the present disclosure, a "combustible" aerosol provision system is one where a constituent aerosolizable material of the aerosol provision system (or component thereof) is combusted or burned in order to facilitate delivery to a user.

According to the present disclose, a "non-combustible" aerosol provision system is one where a constituent aerosolizable material of the aerosol provision system (or component thereof) is not combusted or burned in order to facilitate delivery to a user.

Figure 1:
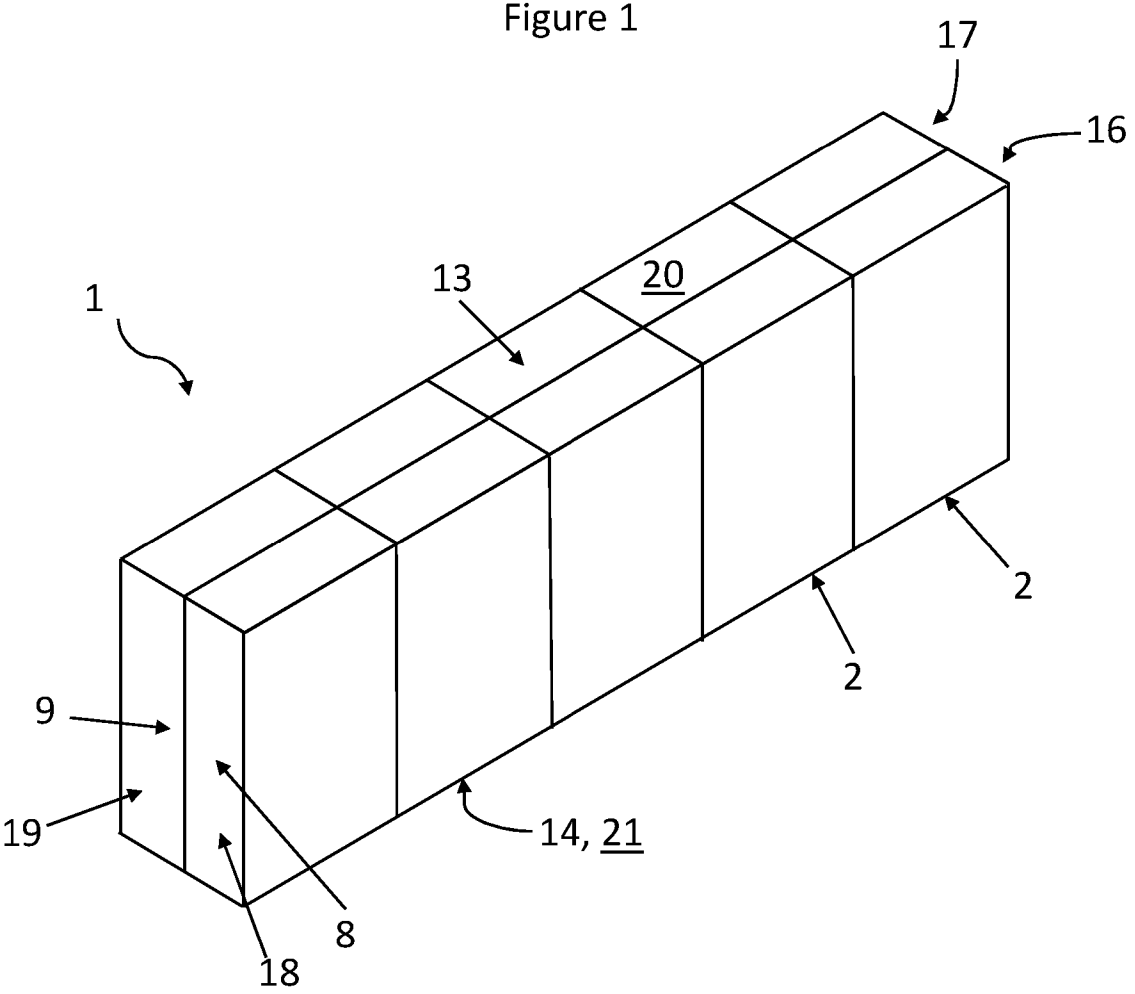
FIG. 1 shows a collation of packages for delivery systems without the single strip of tape attached to the packages.

Referring to FIG. 1, there is shown a collation 1 of packages 2 for delivery systems (not shown). The collation 1 of packages 2 comprises a plurality of individual cuboid-shaped packages 2. An exemplary individual package 2 for delivery systems is shown in FIG. 2.

Figure 2:
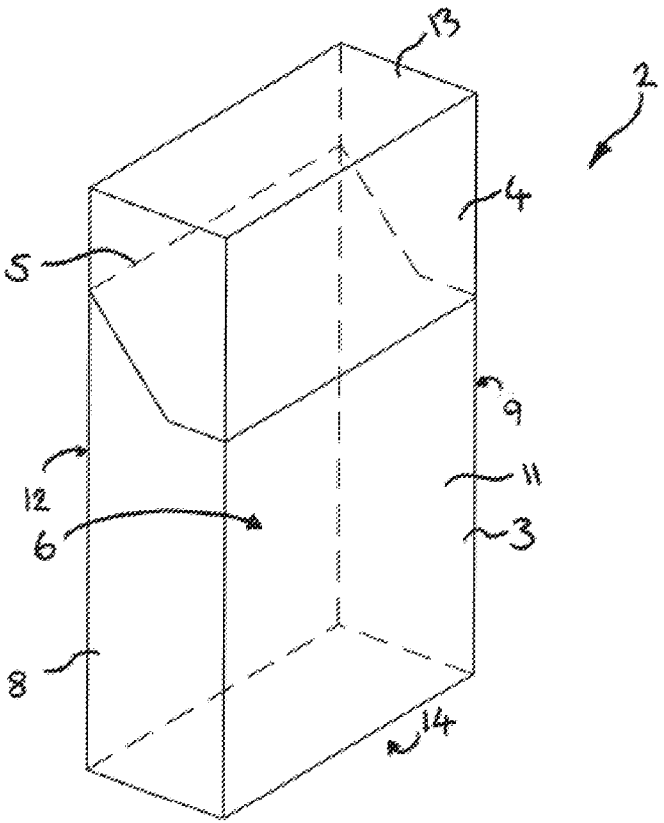
FIG. 2 shows an individual package of a collation of packages.

Referring briefly to FIG. 2, the package 2 may be, for example, but not limited to, a hinge lid pack, as illustrated. The package 2 comprises a container 3 and a lid 4 hingedly connected to the container 3 along a hinge line 5 in order to allow the package to be opened and closed. It will be appreciated that the container 3 forms a delivery system receiving space 6 in which delivery systems such as smoking articles or other tobacco industry products are received and stored. The delivery systems are accessible when the lid 4 is in an open position, and the delivery systems are retained in the delivery system receiving space 6 when the lid 4 is in a closed position. Other types of package, such as those known as clamshell or slide and shell, are also within the scope of the invention.

The package 2 comprises a pair of opposing first faces 11, 12, a pair of opposing second faces 8, 9, and an end face 13, 14. The pair of opposing first faces 11, 12 are separated by the opposing second faces 8, 9. In the present embodiment, the opposing first faces 11, 12 form major panels 11, 12 which make up the front and rear panels of the package 2. The front first face or major panel 11 may comprise a front container wall and a front lid wall. The rear first face or major panel 12 may comprise a rear container wall and a rear lid wall. In the present embodiment, the opposing second faces 8, 9 form minor walls 8, 9 which make up the side walls of the package 2. The second faces or side walls 8, 9 of the package 2 may comprise container side walls and lid side walls. The ends of the package 2 are closed by opposing end faces 13, 14 comprising a top end face 13 and a bottom end face 14. In the present embodiment, the top end face 13 may comprise a lid top wall and the bottom end face 14 may comprise a container bottom wall.

Referring now back to FIG. 1, it can be seen that the plurality of individual packages 2 for delivery systems which make up the collation 1 of packages 2 are arranged into rows. In the embodiment shown in FIG. 1, the collation 1 of packages 2 comprises a first row 16 and a second row 17. The first and second rows 16, 17 are adjacent one another.

In the present embodiment, the packages 2 are arranged into rows 16, 17 such that a second face 8, 9 of a package 2 faces a second face 8, 9 of an adjacent package 2 within the same row 16, 17. Furthermore, the packages 2 are arranged such that a first face 11, 12 of a package 2 in a row 16 faces a first face 11, 12 of a package 2 in an adjacent row 17. In addition, the packages 2 are arranged such that a second face 8, 9 of a package 2 at an end 18, 19 of each row 16, 17, a first face 11, 12 of each package 2 along the rows 16, 17 and each end face 13, 14 are exposed. The exposed end faces 13, 14 of the packages in the collation together form a surface. The collation comprises a top surface 20 and a bottom surface 21 formed by the exposed end faces 13, 14 of the packages 2 respectively. In other words, the top surface 20 of the collation 1 is formed by a combination of the exposed top end faces 13 of the packages 2, and the bottom surface 21 of the collation 1 is formed by a combination of the exposed bottom end faces 14 of the packages 2.

However, it will be appreciated that in alternative embodiments, the packages 2 may be arranged such that a first face 11, 12 of a package 2 faces a first face 11, 12 of an adjacent package 2 within the same row 16, 17 or such that an end face 13, 14 of adjacent packages 2 within the same row 16, 17 face each other.

In the present embodiment, the collation 1 comprises two rows of five packages 2. However, it will be understood that in an alternative embodiment, the number of packages in a row may be different and the number of rows present may be greater.

Figure 3:
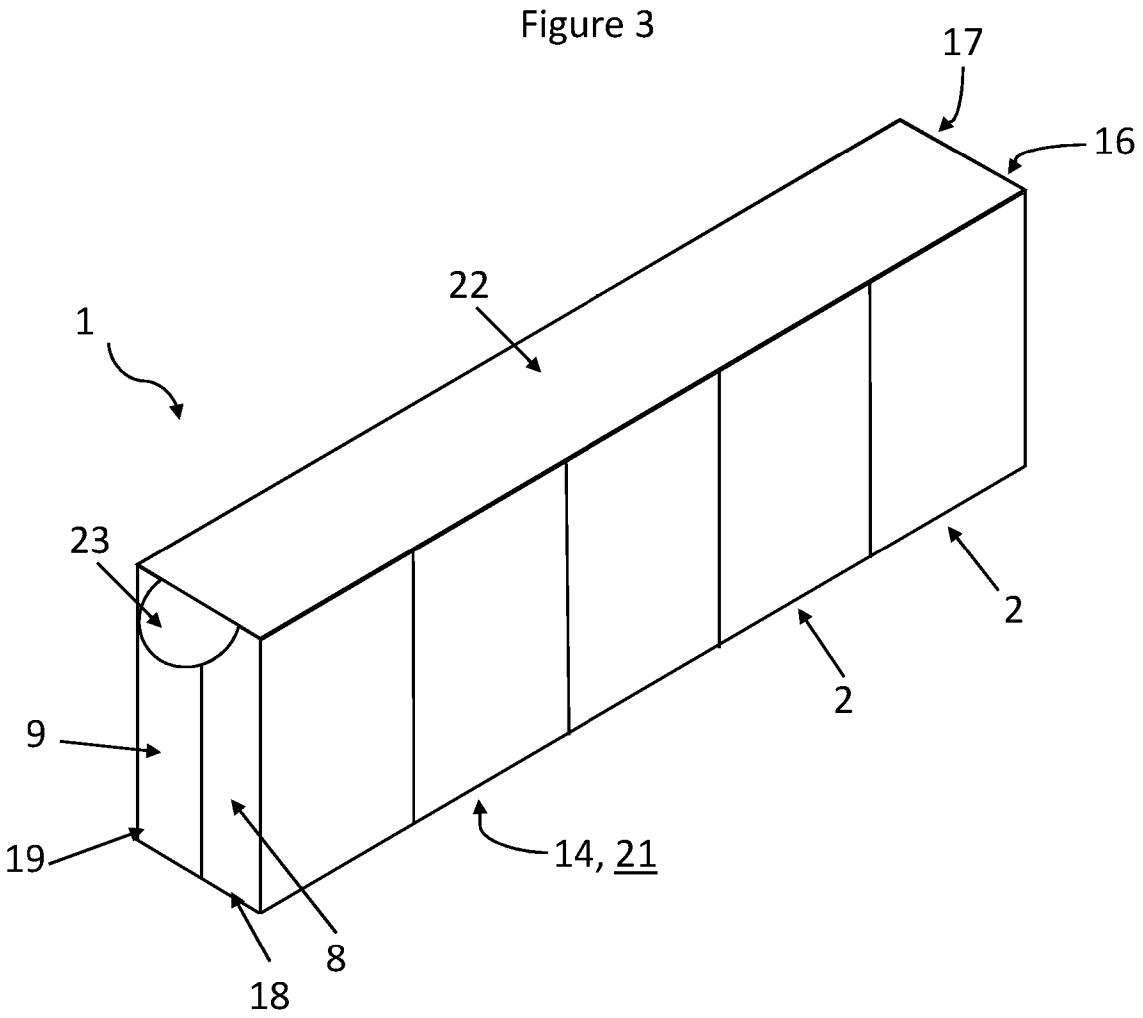
FIG. 3 shows a first embodiment of a collation of packages for delivery systems.

Referring now to FIG. 3, the collation 1 of packages 2 further comprises a single strip of tape 22 configured to attach the packages 2 together in the collation 1. The single strip of tape 22 is adhered only to the surface formed by the end faces 13, 14 of the packages 2 in the collation 1. In other words, the single strip of tape 22 does not extend over any of the exposed first faces 11, 12 or exposed second faces 8, 9 of the packages 2 in the collation 1.

In the present embodiment, the single strip of tape 22 is only adhered to the top surface 20 of the collation 1, formed by the exposed end faces 13 of the packages 2 in the collation 1. It is to be appreciated that in other embodiments, the single strip of tape 22 is only adhered to the bottom surface 21 of the collation, formed by the exposed end faces 14 of the packages 2 in the collation 1. Alternatively, a single strip of tape 22 is adhered to each of the top and bottom surfaces 20, 21 of the collation 1.

If a single strip of tape 22 extends over both the top and bottom surfaces 20, 21 of the collation, one of the strips of tape need not necessarily be adhered to every end face 13, 14. One strip of tape may be adhered to the end faces of some of the packages, and the other strip of tape may be adhered to the end faces of the other packages. However, the packages will be better held in the collation if each strip of tape is attached to all end faces covered by that strip of tape.

As seen in FIG. 3, the single strip of tape 22 extends over the entire width and entire length of the collation 1 to completely cover the top surface 20 of the collation 1. However, it is to be appreciated that the single strip of tape 22 does not necessarily need to extend the full length and width of the collation 1. For example, the single strip of tape 20 may be spaced from the edges of the top and bottom surfaces 20, 21. Additionally, the single strip of tape 22 may extend the full length of the collation 1 but not the full width, or alternatively, the full width of the collation 1 but not the full length. The single strip of tape may cover a portion of each end face 13, 14 that forms the top and bottom surfaces 20, 21 such that each of the packages 2 is retained within the collation 1.

The single strip of tape 22 may be adhered to the entire surface 20, 21 of the collation 1 to which it is attached. Alternatively, the single strip of tape 22 comprises regions of adhesive. At least one region of adhesive is associated with each package 2 in the collation 1 such that the single strip of tape 22 is adhered to every package.

Furthermore, the single strip of tape 22 comprises an extended tab 23 configured to facilitate removal of the single strip of tape 22 from the collation 1. In order to remove packages 2 from the collation 1, a consumer can lift the extended tab 23 and pull the extended tab 23 in a direction along the length of the collation 1. Since the extended tab 23 is integral with the single strip of tape 22, pulling the extended tab 23 in such a way removes the single strip of tape 22 from the collation 1.

Figure 4:
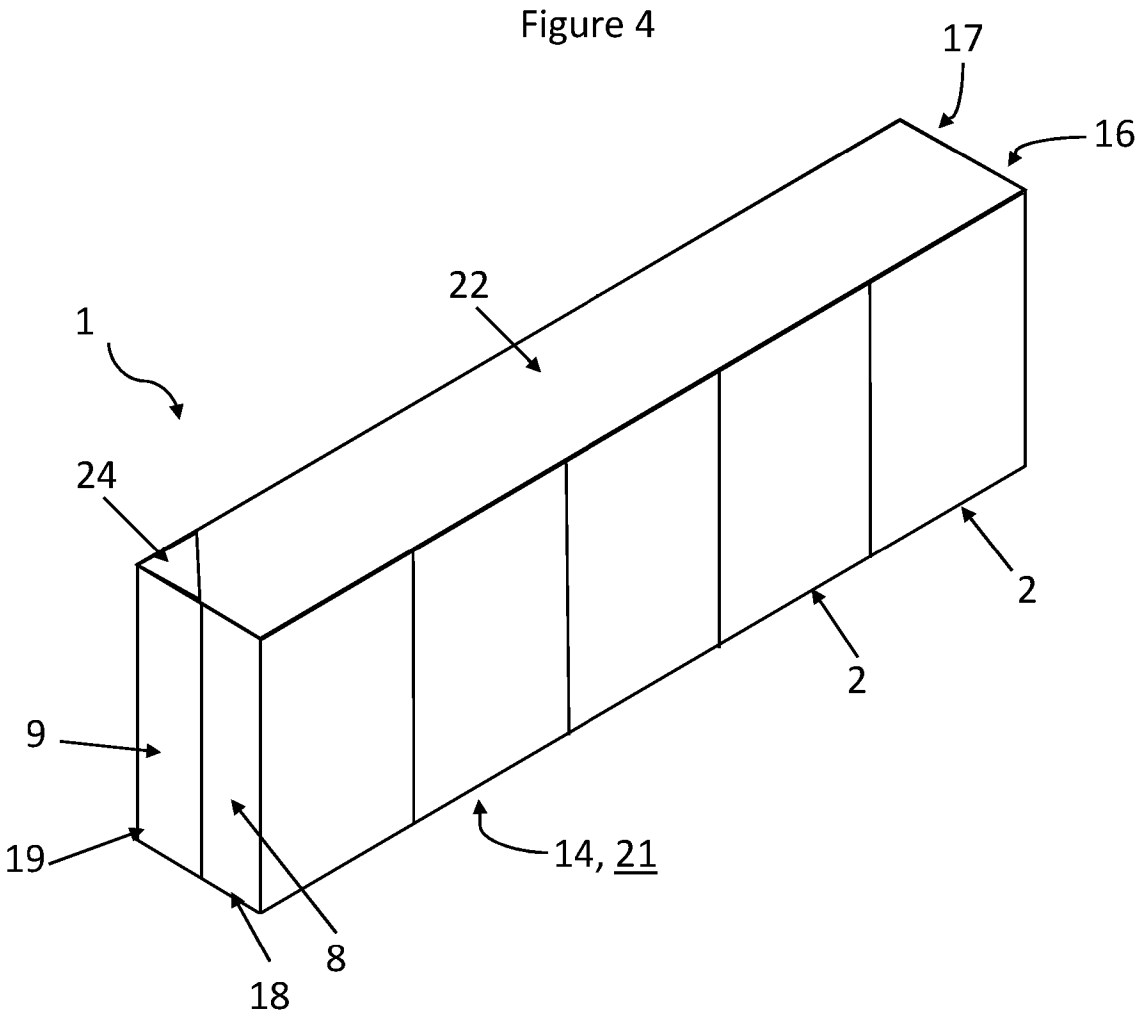
FIG. 4 shows a second embodiment of a collation of packages for delivery systems.

FIG. 4 illustrates another embodiment of the collation 1. The single strip of tape 22 comprises an adhesive free region 24 configured to facilitate removal of the single strip of tape 22 from the collation 1. The adhesive free region 24 is located at an end of the single strip of tape 22. In the present embodiment, the adhesive free region is substantially triangular in shape and is located in one corner of the single strip of tape 22. It is to be appreciated that the adhesive free region may be any shape or size as long as the adhesive free region 24 facilitates removal of the single strip of tape 22 from the collation 1. In order to remove packages 2 from the collation 1, a consumer can lift the adhesive free region 24 and pull the single strip of tape 22 away from the collation 1.

Figure 5:
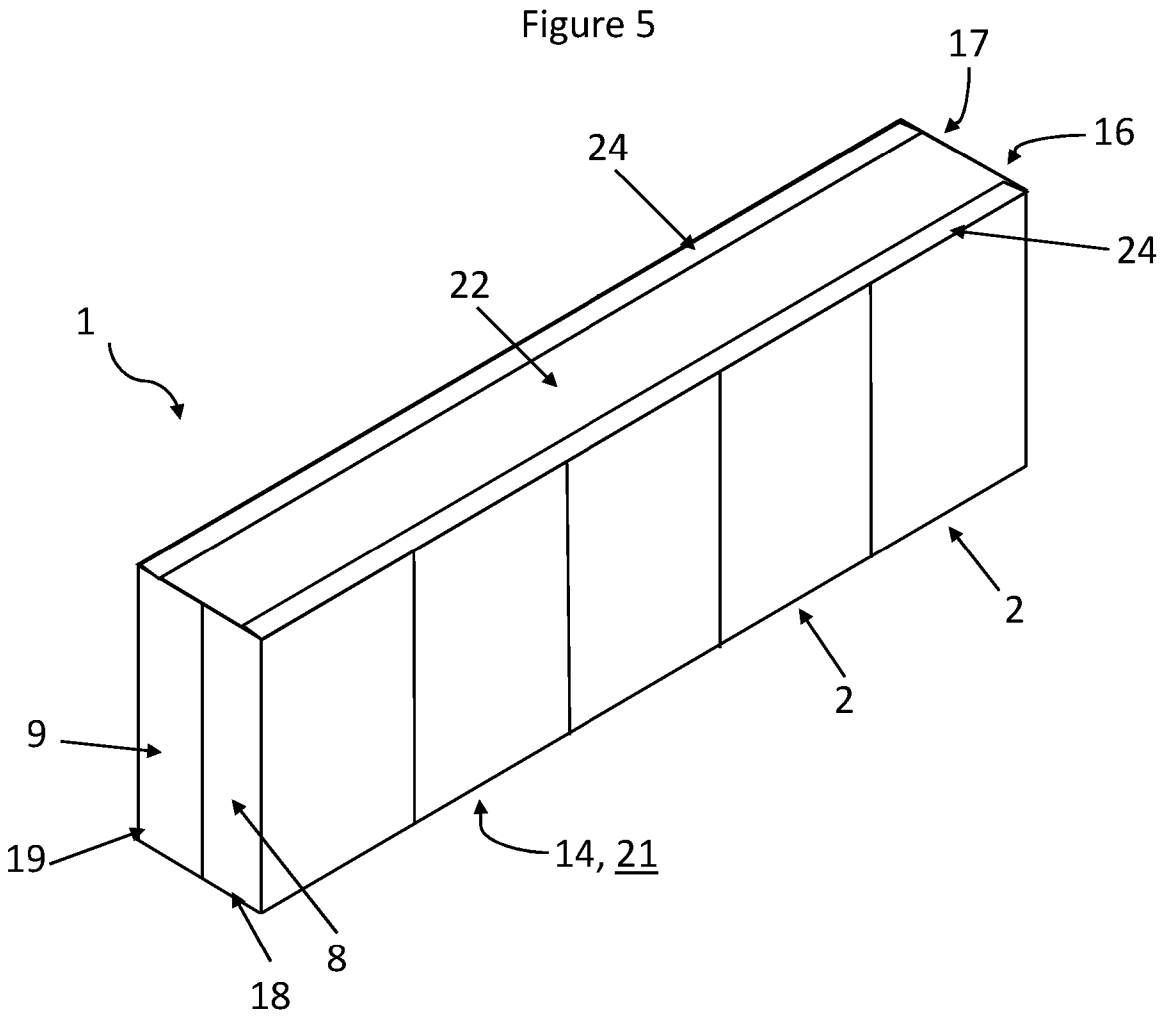
FIG. 5 shows a third embodiment of a collation of packages for delivery systems.

FIG. 5 illustrates another embodiment of the collation 1. Here, the adhesive free region 24 is located at a major edge 25 of the single strip of tape 22 and extends along the length of the collation 1. In order to remove packages 2 from the collation 1, a consumer can lift the adhesive free region 24 and pull the single strip of tape 22 away from the collation 1. In the present embodiment, the single strip of tape 22 comprises a pair of adhesive free regions 24. Each adhesive free region is located at a major edge 25 of the single strip of tape 22 and extends along the length of the collation 1.

It is to be appreciated that the arrangements of the single strip of tape described above are not limited to embodiments where a single strip of tape is adhered to the top or bottom surface of the collation only, but also to embodiments where a single strip of tape is adhered to each of the top and bottom surfaces of the collation, in which case there is a single strip of tape covering the top surface of the collation, and another single strip of tape covering the bottom surface of the collation. The single strips of tape adhered to each of the top and bottom surfaces may comprise the same features, however it is also envisaged that the single strips of tape adhered to each of the top and bottom surfaces of the collation may be different. For example, the single strips of tape adhered to each of the top and bottom surfaces of the collation may both comprise an extended tab as illustrated in FIG. 3. Alternatively, for example, the single strip of tape adhered to the top surface of the collation may comprise the extended tab illustrated in FIG. 3, and the single strip of tape adhered to the bottom surface of the collation may comprise the adhesive free region as illustrated in FIG. 4. It is to be appreciated that the single strips of tape may comprise any combination of the features disclosed above.

The single strip of tape may be formed from a film material. In particular, the film material may be transparent to allow a consumer to read information provided on the end faces of the packages in the collation. Alternatively, the single strip of tape may be formed from a paper-based material for recyclability. Additionally, the single strip of tape may comprise indicia, for example product codes which may be scanned or general information in relation to the packages in the collation.

Figure 6:
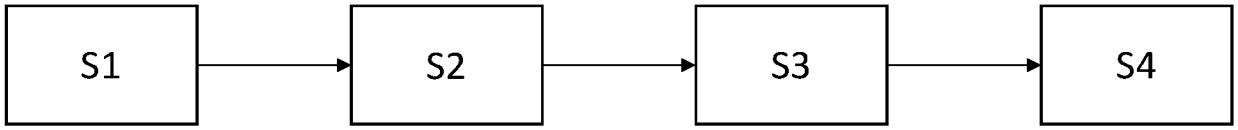
FIG. 6 shows a method of retaining packages together in a collation.

FIG. 6 illustrates a method of retaining a packages together in a collation. The method comprises a first step S1 which includes providing a collation of cuboid-shaped packages, each package comprising a pair of opposing first faces, a pair of opposing second faces and an end face. The second step S2 involves arranging the packages in rows such that a second face of a package faces a second face of an adjacent package within the same row, and a first face of a package in a row faces a first face of a package in an adjacent row, a second face of a package at the end of each row, a first face of a package in a row, and each end face being exposed. The third step S3 comprises forming a surface with the exposed end faces of the packages in the collation. Finally, the fourth step S4 comprises adhering a single strip of tape only to said surface of the collation to attach the packages in the collation together.

The various embodiments described herein are presented only to assist in understanding and teaching the claimed features. These embodiments are provided as a representative sample of embodiments only, and are not exhaustive and/or exclusive. It is also to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A collation of packages, each package of the collation being cuboid-shaped and comprising a pair of opposing first faces, a pair of opposing second faces and an end face;

wherein the packages are arranged in rows such that a second face of a package faces a second face of an adjacent package within the same row, and a first face of a package in a row faces a first face of a package in an adjacent row, a second face of a package at the ends of each row, a first face of each package in a row, and each end face being exposed;

wherein the exposed end faces of the packages in the collation together form a surface; and wherein a single strip of tape is adhered only to said surface of the collation such that the single strip of tape attaches the packages in the collation together.

2. A collation of packages according to claim 1, wherein each of said packages comprises a lid, and wherein said end face is formed by the lid such that the exposed end faces of the packages in the collation together form a top surface.

3. A collation of packages according to claim 1, wherein each of said packages comprise a base, and wherein said end face is formed by the base such the exposed end faces of the packages in the collation form a bottom surface.

4. A collation according to claim 1, wherein each of said packages comprise a lid and a base, and wherein the end face comprises a lid end face and a base end face, such that the exposed lid end faces of the packages in the collation form a top surface and the exposed base end faces of the packages in the collation form a bottom surface, wherein a single strip of tape is adhered to each of the top surface and the bottom surfaces of the collation.

5. A collation of packages according to claim 1, wherein the single strip of tape extends over the entire width of the surface.

6. A collation of packages according to claim 1, wherein the single strip of tape extends over the entire length of the surface.

7. A collation of packages according to claim 1, wherein the single strip of tape is adhered to the entire surface of the collation to which it is attached.

8. A collation of packages according to claim 1, wherein the single strip of tape comprises regions of adhesive, at least one region being associated with each package in the collation such that the single strip of tape is adhered to every package.

9. A collation of packages according to any preceding claim 1, wherein the single strip of tape comprises an extended tab configured to facilitate removal of the single strip of tape.

10. A collation of packages according to claim 1, wherein the single strip of tape comprises an adhesive free region configured to facilitate removal of the single strip of tape from the collation.

11. A collation of packages according to claim 10, wherein the adhesive free region is located at an end of the single strip of tape.

12. A collation of packages according to claim 10, wherein the adhesive free region is located at a major edge of the single strip of tape and extends along the length of the collation.

13. A collation of packages according to claim 10, wherein the single strip of tape comprises a pair of adhesive free regions, each adhesive free region being located at a major edge of the single strip of tape and extending along the length of the collation.

14. A method of retaining packages together in a collation, the method comprising:

providing a collation of cuboid-shaped packages, each package comprising a pair of opposing first faces, a pair of opposing second faces and an end face;

arranging the packages in rows such that a second face of a package faces a second face of an adjacent package within the same row, and a first face of a package in a row faces a first face of a package in an adjacent row, a second face of a package at the ends of each row, a first face of each package in a row, and each end face being exposed;

forming a surface with the exposed end faces of the packages in the collation; and adhering a single strip of tape only to said surface of the collation to attach the packages in the collation together.

* * * * *